US006050853A

United States Patent [19]

Ando et al.

[11] Patent Number: 6,050,853

[45] **Date of Patent: *Apr. 18, 2000**

[54] ANGLED CIRCUIT BOARD CONNECTOR

[75] Inventors: Shigeru Ando, Yamato, Japan; Maxwill P. Bassler, Hampshire, Ill.

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/063,886

[22] Filed: Apr. 22, 1998

[30] Foreign Application Priority Data

Apr. 25, 1997 [JP] Japan ..... 9-123333

[51] Int. Cl.[7] ..... H01R 13/648

[52] U.S. Cl. ..... 439/607; 439/571; 439/954

[58] Field of Search ..... 439/571, 607, 439/326, 637, 954

[56] References Cited

U.S. PATENT DOCUMENTS

| | | | |
|---|---|---|---|
| 5,013,262 | 5/1991 | Shibano | 439/610 |
| 5,017,156 | 5/1991 | Sugiyama | 439/607 |
| 5,017,158 | 5/1999 | Liu et al. . | |
| 5,035,652 | 7/1991 | Shibano | 439/610 |
| 5,073,130 | 12/1991 | Nakamura | 439/607 |
| 5,083,945 | 1/1992 | Miskin et al. . | |
| 5,266,038 | 11/1993 | Nakamura | 439/79 |
| 5,288,248 | 2/1994 | Chen . | |
| 5,338,215 | 8/1994 | Lee et al. | 439/188 |
| 5,460,537 | 10/1995 | Noschese | 439/326 |
| 5,511,985 | 4/1996 | Noschese | 439/637 |
| 5,601,451 | 2/1997 | Driones et al. . | |

OTHER PUBLICATIONS

"Full Line Catalog 990"Molex Incorporated pp. E–35 and E–36, how to file Single Row, Metal Latch SPMM (1991).

"Full Line Catalog 990", Molex Incorporated, pp. Q–96, Q–97, Q–103 & Q–114 (1991).

*Primary Examiner*—Gary Paumen
*Assistant Examiner*—Antoine Nganojui
*Attorney, Agent, or Firm*—Charles S. Cohen

[57] ABSTRACT

Disclosed is an improved board connector having an insulating housing with terminals mounted therein and an exterior shell fitting on the insulating housing. The exterior shell has long and short legs that fix the connector to a printed circuit board at a predetermined oblique angle to permit the oblique insertion of an opposing connector into the board connector without fear of interference with surrounding components. Thus, there is no need to leave extra space ahead of the connector to permit the opposing connector to lay flat ahead of the board connector on the circuit board when mating the two connectors together.

20 Claims, 4 Drawing Sheets

ANGLED CIRCUIT BOARD CONNECTOR

BACKGROUND OF THE INVENTION

The present invention relates to generally to circuit board connectors, and more particularly to circuit board connectors for peripheral devices.

Many connectors for circuit boards are known in the art. One such conventional electrical connector is used on a circuit board or mother board used in a computer and it includes an insulative housing having a plurality of terminals mounted therein and a metal grounding shell surrounding the connector housing. The terminals have tail portions formed thereon that are connected to selected circuits formed on the printed circuit board. The metal shell has legs for fixing the connector to the circuit board. The connector has an inlet that accommodates an opposing electrical connector on its front side, thereby permitting the wires of the opposing connector to be electrically connected to selected conductors of the circuit.

This type of connector is designed for close attachment to the circuit board with the bottom of the connector upon the upper surface of the circuit board, and thus places the connector inlet parallel to the upper surface of the printed circuit board. With this structure, it is necessary that the connector is positioned on the circuit board in an area that has enough space to permit an opposing connector to be laid ahead of the connector to permit the coupling and decoupling of the opposing connector to and from the connector that is fixed to the printed circuit board. This is disadvantageous from the standpoint of making the most effective use of the limited space available on the circuit mother board. It also significantly prevents a reduction in size of the electronic device.

Such a circuit board connector is commonly used in computers by connecting a peripheral device, such as a video camera or other device to the computer circuit board. Because such connectors require a predetermined space in front of them to effect such a connection, these known connectors are located at the rear of the computer and the connection point for the peripheral device is at the rear of the computer. This necessitates the user to reach around to the rear of the computer to make the connection, which is not always feasible.

SUMMARY OF THE INVENTION

The present invention is directed to a circuit board connector that overcomes the aforementioned disadvantages.

Accordingly, one object of the present invention is to provide a connector for enabling a connection with a circuit board in which the connector permits the most effective use of limited space on a printed circuit board.

Another object of the present invention is to provide a connector that engages a circuit board in an orientation that assures a sufficient space is available near the connector to allow an opposing connector to be handled without interference and inserted into the connector fixed to the circuit board.

Still another object of the present invention is to provide a connector that engages a circuit board and receives an opposing connector for a computer peripheral device, the connector having an exterior metal shell that provides a ground connection and which supports the connector at an angle from the circuit board so that an opposing connector may be easily inserted into and removed from the connector without interfering with nearby components on the circuit board.

Yet another object of the present invention is to provide a circuit board connector for use in a computer for establishing a connection between a peripheral device and one or more circuits of the computer, wherein the connector includes a housing that supports a plurality of conductive terminals therein, the housing including an exterior support jacket that partially encloses the housing and supports it on a circuit board of the computer, the support jacket having two pairs of first and second mounting legs that are received within corresponding openings on the circuit board, the first and second mounting legs having different heights such that the connector is supported on the circuit board and maintained in an angled position that orients a connector slot of the connector upward at an angle from the circuit board, whereby an opposing connector may be mated with the board connector without interference with any components on the circuit board, thereby saving space on the circuit board and permitting a cable leading to a peripheral device connector to be routed to a connection in front of the computer.

To attain these objects, the connectors of the present invention is designed for mounting at an angle to the circuit board surface, with the connector having a mating face that is directed upward at an oblique angle from the upper surface of the printed circuit board.

The connector includes an insulative housing with a plurality of conductive terminals mounted therein and a metal shell mounted on the housing. Each of the terminals includes a contact portion supported on the housing and an opposing tail portion that extends out of the housing for effecting the required connections to selected circuits of the circuit board. The metal shell includes mounting legs that extend therefrom and which fix the connector to the circuit board at an angle upward from the circuit board. The connector has a receptacle that accommodates an opposing connector and the mounting legs are dimensioned and positioned to permit the connector to be mounted on the circuit board at a predetermined oblique angle upward and away from the circuit board upper surface.

The mounting legs of the connector may include a pair of relatively short legs disposed on opposite sides of the rear portion of the connector metal shell, which rear portion surrounds the rear end of the connector housing, and a pair of relatively long legs disposed on opposite sides of an intermediate section of the metal shell, which intermediate section surrounds the forward portion of the connector housing. With this structure, the opposing connector can be easily inserted into the receptacle of the angled connector without interfering with any electronic components on the circuit board near or in front of the board connector. Thus, there is an access path created for the opposing connector in the free space obliquely above the connector without fear of interfering with surrounding components. The connector of the present invention may be mounted on a circuit board without leaving extra space ahead of the connector, which would be required if the connector were mounted flat on the circuit board.

The metal shell of the connector may include opposing sidewalls and top and bottom walls that together define an inlet. A rear wall is connected to the top wall to cover the rear surface of the connector housing, and opposing side covers are connected to associated, opposing edges of the rear wall. The pair of rear mounting legs are connected to the lower sections of the opposing side covers, while the pair of front mounting legs are also connected to the lower, sections of the opposing side covers.

The front and rear mounting legs may include projecting portions that extend through the circuit board thickness and which provide contact points for attaching the connector to the circuit board, such as by soldering. The mounting legs may further include stepped portions that engage the top surface of the circuit board in a common plane to set the angle of the connector. Alternatively, the mounting leap may contact the upper surface of the circuit board. The terminals of the connector may either reach the upper surface of the circuit board or may pass through the circuit board for attachment.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENTS

Figure 1:
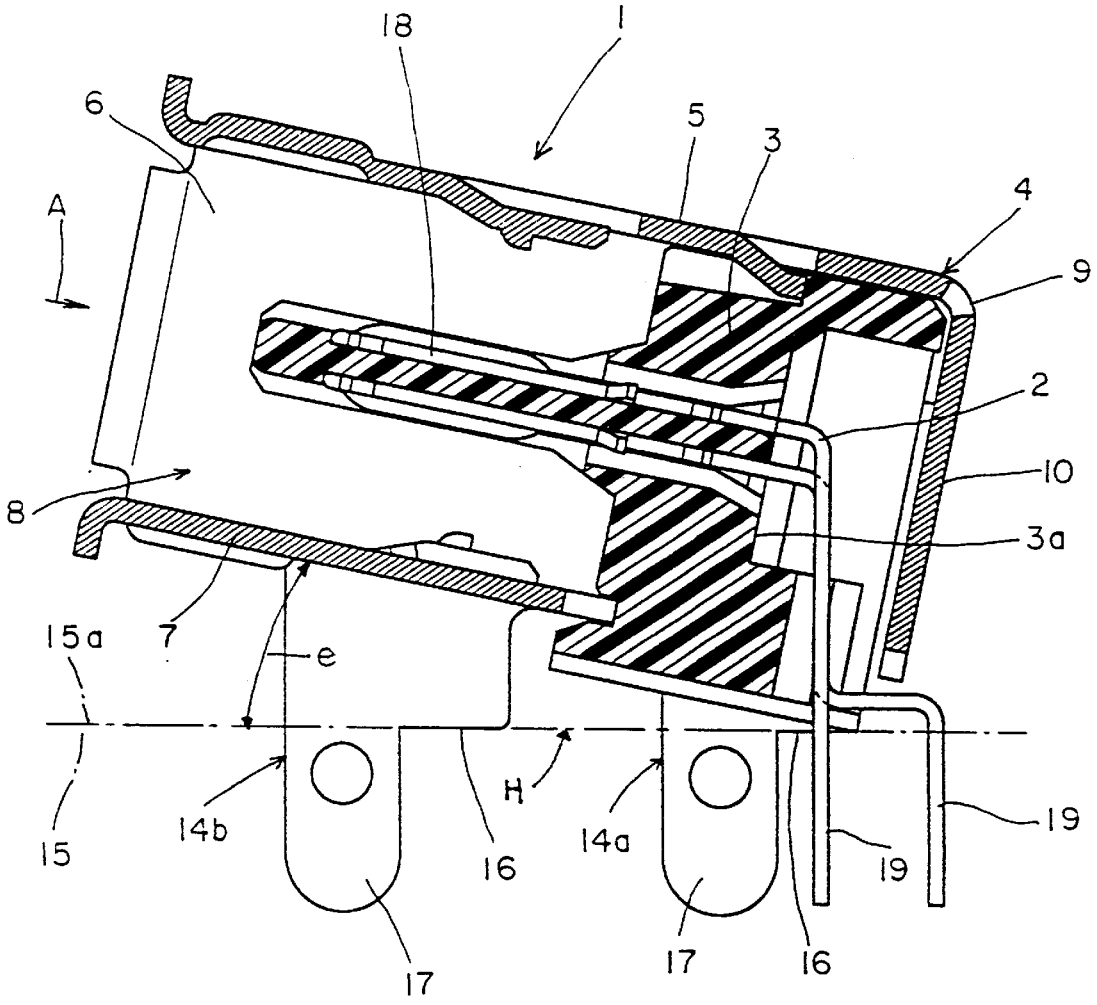
FIG. 1 is sectional view of a circuit board connector constructed in accordance with the principles of the present invention.

Referring now to FIG. 1, a circuit board connector constructed in accordance with the principles of the present invention is shown generally at 1. The connector 1 includes an electrically insulative housing 3 having a plurality of terminals 2 supported there and an exterior metal shell 4 that at least encloses partially the connector housing 3. This exterior metal shell 4 includes a top wall 5, two opposing (or left and right) sidewalls 6 and a bottom wall 7. These walls cooperatively define an inlet portion, or receptacle 8, of the exterior shell 4 that accommodates an opposing connector 21, which may be inserted in the receptacle 8 in the oblique direction indicated by "A".

Figure 3:
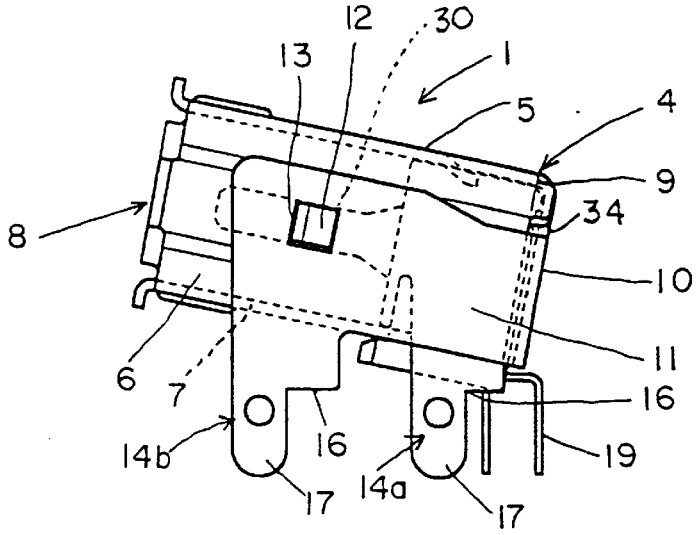
FIG. 3 is a side elevational view of the connector of FIG. 1.

As shown in FIG. 3, each sidewall 6 has an engagement lug 12 that is stamped therein and is surrounded by a U-shaped slot 30. This lug 12 is illustrated as rectangular in configuration but it will be understood that other configurations may be used. The lugs 12 are slightly raised from the level of the sidewalls 6 in order to engage a cover portion 11 as explained in greater detail below.

Figure 4:
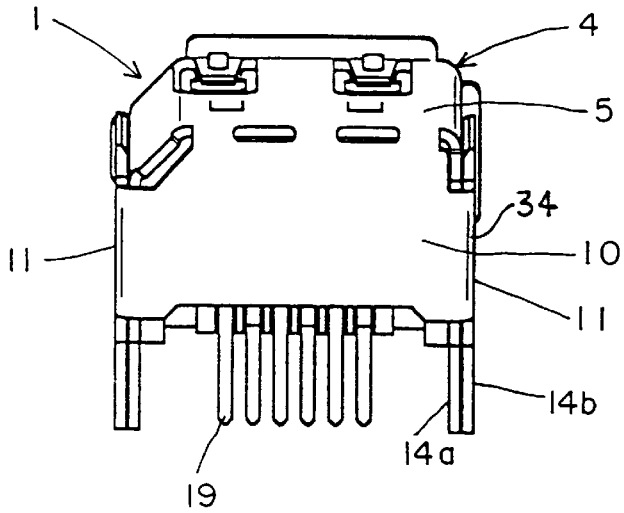
FIG. 4 is a rear elevational view of the connector of FIG. 1.
Figure 5:
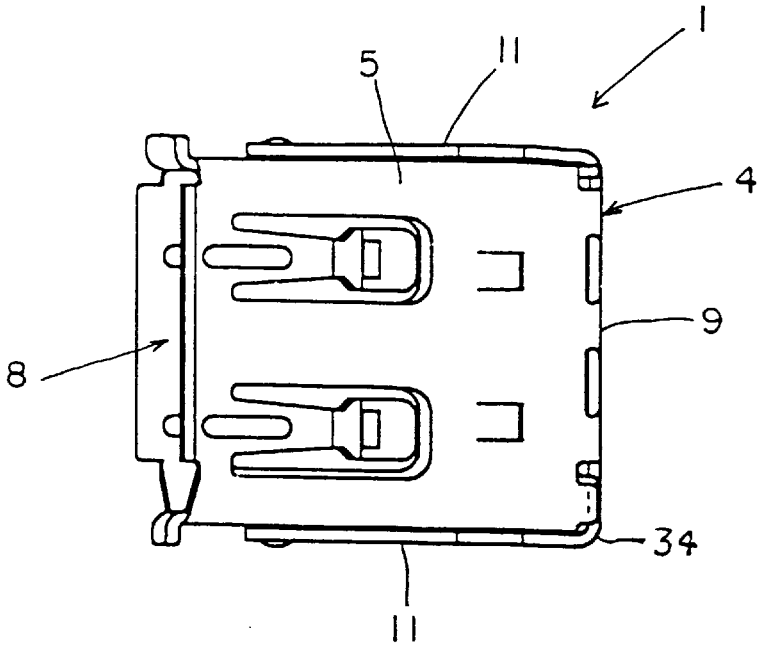
FIG. 5 is a top plan view of the connector of FIG. 1.
Figure 6:
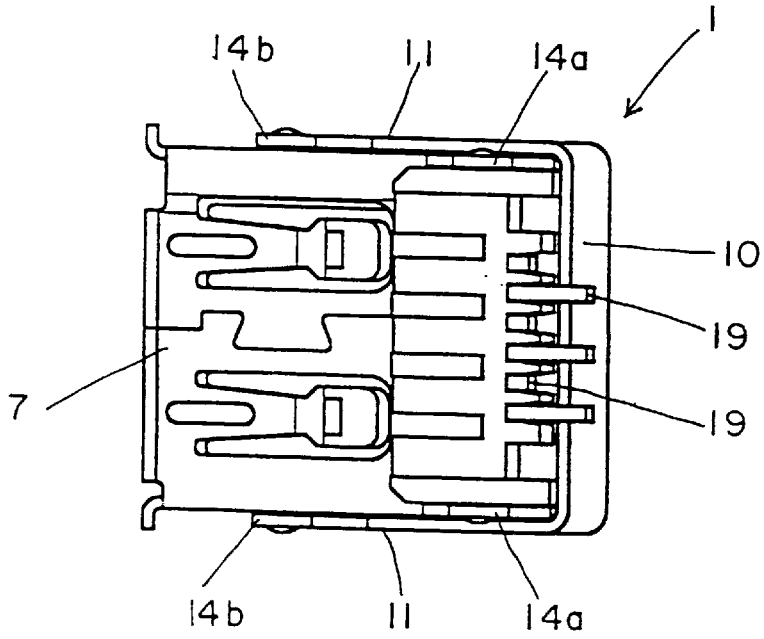
FIG. 6 is a bottom plan view of the connector of FIG. 1; and, FIG. 7 is an elevational view of the connector of FIG. in place on a circuit board with a cable connected thereto way of an opposing connector illustrating the clearance vantage of the present invention provides.

The rear wall 10 of the exterior metal shell 4 is shown as formed with the upper rear edge 9 of the top wall 5 and is best illustrated in FIGS. 5 and 4. In the embodiment illustrated, the rear wall 10 is drawn as bent along the rear upper edge 9 of the top wall 5 so that it extends down to cover the rear surface 3*a* of the connector housing 3. Likewise, in the embodiment specifically in FIG. 5, the sidewalls 11 of the exterior metal shell 4 are formed with the rear wall 10 and are bent along the rear, vertical edges 34 of the exterior shell 4.

Each side cover 11 preferably has a window, or other type of opening 13 formed therein (FIG. 3) that is generally aligned with the engagement lug 12. When the side covers 11 are bent over the sidewalls 6, the window 13 becomes positioned so as to engage and catch the engagement lug 12 therewithin in order to join the sidewalls 6 of the exterior shell 4 with their associated overlying side covers 11.

In an important aspect of the present invention and as illustrated in FIGS. 1 and 3, the connector 1 is provided with a means for mounting the connector 1 at an oblique angle θ from the surface 15*a* of the circuit board 15. This mounting means is illustrated in the preferred embodiment as pairs of first and second mounting legs 14*a*, 14*b* that extend from the exterior shell 4 and are formed therewith. The first and second mounting legs 14*a*, 14*b* are respectively positioned at the rear and front of the connector 1. The rear mounting legs 14*a* have a height that is less than that of the front mounting legs 14*b* in order to angle the connector 1 upwardly at the desired angle θ.

Figure 2:
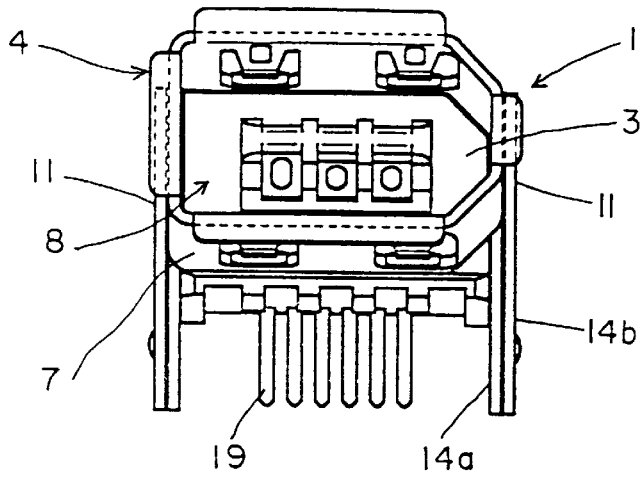
FIG. 2 is a front elevational view of the connector of FIG. 1.
Figure 7:
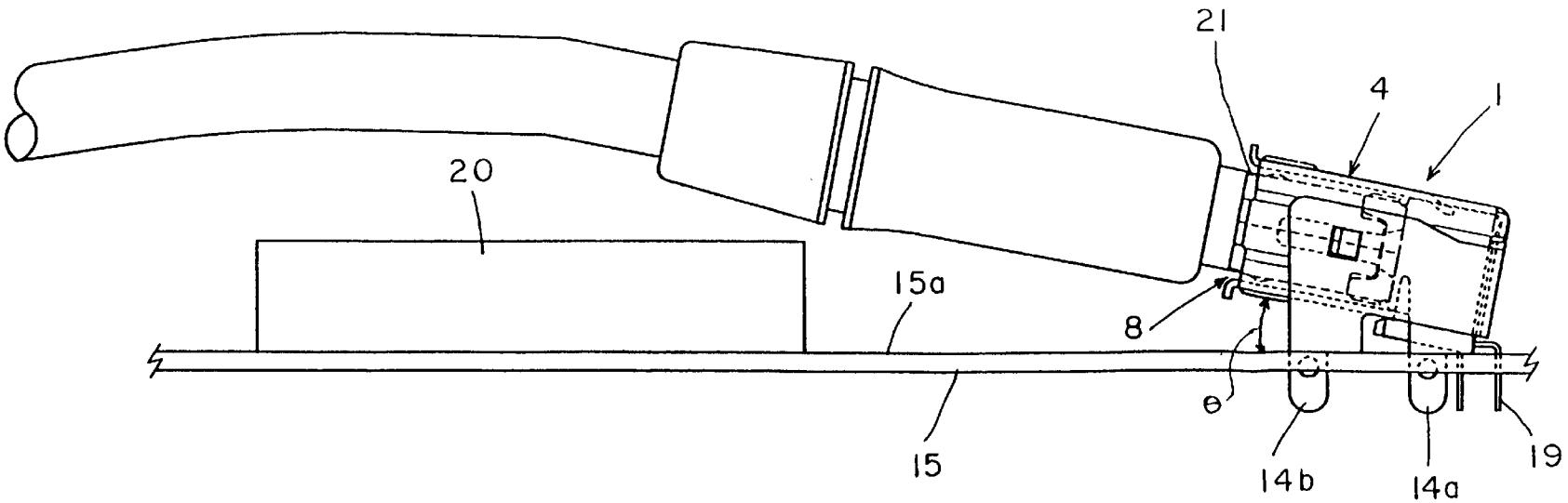

In the preferred embodiment illustrated, the rear mounting legs 14*a* are formed with the sidewalls 6 while the front mounting legs 14*b* are formed within the side covers 11. As shown in FIG. 2, the rear mounting legs 14*a* lie interior of the front mounting legs 14*b*. With the difference in height of the mounting legs 14*a*, 14*b*, the receptacle 8 is maintained at the oblique upward angle θ. The angled receptacle 8 of the connector permits an opposing connector 21 to be inserted into and removed from the connector 1 without interfering with an adjacent electronic component 20 mounted on the circuit board 15 as illustrated in FIG. 7. This results in a saving of space on the circuit board 15 which may, in turn promote the reduction in size of the electronic device that houses the circuit board 15.

The mounting legs 14*a* and 14*b* are long enough to pass through the thickness of the circuit board 15. Each mounting leg 14*a*, 14*b* preferably includes a shoulder or step portion 16 formed thereon that defines the height difference between the mounting legs 14*a*, 14*b*. These shoulder portions 16 extend and abuttingly engage the common surface 15*a* of the circuit board when the mounting legs 14*a*, 14*b* are inserted into the circuit board 15. As seen in FIG. 1, these shoulder portions 16 are maintained in a common horizontal plane H. Each mounting leg 14*a*, 14*b* further preferably includes a neck portion 17 that is disposed adjacent the shoulder portions 16 and which extends through the circuit board 15 as illustrated in FIG. 7. These neck portions 17 provide attachment surfaces that may be soldered to appropriate circuits on the circuit board 15, such as grounding circuits.

Each connector terminal 3 includes a contact portion 18 that extends within the receptacle 8 and is supported by the connector housing 3 as well as a tail portion 19 that extends from the rear 3*a* of the connector housing 3. The tails 19 descend from the rear 3*a* of the connector housing 3, and may as shown, extend parallel with the mounting legs 14*a* and 14*b*. The tail portions 19 shown are long enough to extend through the circuit board 15 for soldering on the bottom surface thereof, if appropriate.

Referring to FIG. 7, the connector 1 may be attached to the circuit board 15, which has a circuit element or other electronic component 20 attached thereto in the vicinity of the connector 1. As seen in FIG. 7, the connector 1 is attached to the circuit board 15 by way of its mounting legs 14*a* and 14*b* that stand on and engage the surface 15*a* of the circuit board 15, thereby inclining the connector 1 and its receptacle 8 with respect to the upper surface 15*a* of the circuit board 15 obliquely upwardly. This permits an oblique insertion of an opposing connector 21 into the receptacle 8 through the free space above the receptacle 8 without fear of interfering with any surrounding components 20. Therefore, the connector, can be attached close to the component 20 on the circuit board 15, leaving no significant extra space ahead of the board connector 1, and thereby advantageously increasing the density with which components may be mounted to the overall circuit board 15, and hence permitting the reduction of the size of device.

In this particular embodiment, the angle at which the counter electric connector can be inserted in the electric connector 1, which is obliquely fixed to the printed circuit board 15, is set to be about 11° with respect to the upper surface 15*a* of the printed circuit board 15. This specific degree of insertion angle, is not restrictive; the insertion angle will depend on the size and shape of surrounding components.

The mounting legs 14*a* and 14*b* of the exterior shell 4 and the tails 19 of the terminals 2 pass through the thickness of the printed circuit board 15, thereby permitting the dip-soldering of such elements to the circuit board 15. Alternatively, they may be modified to extend onto opposing contact pads (not shown) on the upper surface 15*a* of the circuit board 15, to thereby permitting the reflow soldering thereof.

As may be understood from the above, the electric connector according to the present invention permits a counter electric connector to have an access thereto obliquely above in the free space, thereby making it unnecessary to leave ahead of the electric connector an extra space large enough to permit the counter electric connector to get an access to the electric connector in front thereof. This has the effect of increasing the density with which parts and elements can be mounted on the printed circuit board.

While the preferred embodiment of the invention have been shown and described, it will be apparent to those skilled in the art that changes and modifications may be made therein without departing from the spirit of the invention, the scope of which is defined by the appended claims.

We claim:

1. A circuit board connector for effecting a connection between circuits on a circuit board and a predetermined electronic component, comprising:

an insulative connector housing;

a plurality of conductive terminals supported on a support surface of the connector housing, the terminals having contact portions and tail portions, the terminal contact portions being supported on said connector housing support surface and the terminal tail portions extending out of said connector housing in position for attachment to the circuit board;

the connector having a receptacle for receiving a mating portion of an opposing connector therein, said connector housing support surface and said terminal contact portions being disposed within the receptacle;

an exterior shell partially enclosing said connector housing, the exterior shell having top and bottom walls and a pair of opposing sidewalls, the top, bottom and sidewalls at least partially defining said receptacle;

said connector further including means for mounting said connector to said circuit board so as to position said connector receptacle at a predetermined oblique, upward angle with respect to an upper surface of said circuit board;

said connector mounting means including first and second pairs of mounting legs for engaging said circuit board, the first and second pairs of mounting legs being formed from said exterior shell, said first and second pairs of mounting legs having different heights to thereby orient said connector inlet opening at said predetermined oblique upward angle.

2. The circuit board connector as defined in claim 1, wherein said oblique, upward angle is an acute angle.

3. The circuit board connector as defined in claim 1, wherein said exterior shell and said first and second mounting legs are formed from a conductive metal plate such that said exterior shell provides an exterior grounding shield for said connector.

4. The circuit board connector as defined in claim 1, wherein said mounting legs each include an engagement portion that abuttingly contact an upper surface of said circuit board when said connector is mounted to said circuit board, the engagement portions of all of said mounting legs being aligned in a common horizontal plane.

5. The circuit board connector as defined in claim 1, wherein said first and second mounting legs each include a stem portion that is received within a corresponding, opposing opening of said circuit board when said connector is mounted to said circuit board; and, each of said first and second mounting legs further include shoulder portions that adjoin said stem portions, said shoulder portions having defined engagement surfaces formed thereon that abut the upper surface of said circuit board when said stem portions are received within said circuit board openings.

6. The circuit board connector as defined in claim 5, wherein said first mounting legs are positioned interior of said second mounting legs.

7. The circuit board connector as defined in claim 5, wherein said first and second mounting leg shoulder portions are aligned with each other along a common horizontal plane.

8. The circuit board connector as defined in claim 1, wherein said exterior shell includes a rear wall and said sidewalls are integrally connected with top wall and said rear wall is also integrally connected with said top wall.

9. The circuit board connector as defined in claim 8, wherein said rear wall further includes a pair of opposing side cover portions integrally connected thereto and folded over said sidewalls, said first mounting legs being integrally connected to said sidewalls and said said second mounting legs being integrally connected to said side cover portions.

10. The circuit board connector as defined in claim 9, wherein each of said side cover portions include an opening formed therein and each of said sidewalls include an engagement lug extending outwardly therefrom, said side cover portion openings being aligned with said engagement lugs.

11. A circuit board connector for effecting a connection between circuits on a circuit board and a predetermined electronic component, the connector requiring a minimum amount of circuit board space for effecting the connection when mounted to the circuit board, said connector comprising:

an insulative connector housing;

a plurality of conductive terminals supported on a support surface of the connector housing, the terminals having contact portions supported on said connector housing support surface and having tail portions extending out of said connector housing in position for attachment to said circuit board;

said connector having an opening for receiving a mating portion of an opposing connector therein, said connector housing support surface and said terminal contact portions being disposed within the connector opening;

said connector further including an exterior shell thereof at least partially encloses said connector housing and at least partially defines said connector opening;

said exterior shell including means for mounting said connector to said circuit board at a predetermined oblique, upward angle with respect to said circuit board such that said inlet opening extends upwardly at the predetermined oblique angle;

said connector mounting means including first and second pairs of mounting legs formed as part of said exterior shell for engaging said circuit board, said first and second pairs of mounting legs having respective post portions that are received within corresponding mounting openings in said circuit board when said connector is mounted to said circuit board, said first and second pairs of mounting legs also having respective shoulder portions associated therewith and that adjoin the mounting leg post portions, the shoulder portions having engagement surfaces defined thereon that abut said circuit board when said post portions are received within said circuit board mounting openings; and, said first pair of mounting legs having a height greater than a height of said second pair of mounting legs to thereby orient said inlet opening upwardly at said predetermined oblique angle from said circuit board.

12. The circuit board connector of claim 11, wherein said mounting leg shoulder portions are aligned in a common horizontal plane.

13. The circuit board connector of claim 11, wherein said exterior shell and said first and second pairs of mounting legs are formed from a conductive metal plate, whereby said exterior shell provides an exterior grounding shield for said connector.

14. The circuit board connector of claim 11, wherein said oblique angle is an acute angle of about 11°.

15. The circuit board connector of claim 11, wherein said exterior shell includes a rear wall, a top wall, a bottom wall and two opposing sidewalls, said sidewalls being integrally formed with the top wall and said rear wall also being integrally formed with said top wall.

16. A circuit board connector for establishing a connection between predetermined circuits on a circuit board and an opposing connector, the connector requiring a minimum amount of circuit board space in front of the connector for effecting the connection when said connector is mounted to the circuit board, said connector comprising:

an insulative connector housing;

a plurality of conductive terminals supported by the connector housing;

said connector having an open slot defined thereon for receiving a mating portion of an opposing connector therein, said conductive terminals being disposed within the open slot;

an exterior shell at least partially enclosing said connector housing and at least partially defining said open slot;

said exterior shell including sets of first and second mounting legs for mounting said connector to said circuit board at a predetermined oblique, upward angle with respect to said circuit board such that said open slot extends upwardly at the predetermined oblique angle;

said first and second mounting legs having respective circuit board-contacting portions for contacting said circuit board when said connector is mounted on said circuit board; and, said first mounting legs having a height greater than a height of said second mounting legs to thereby orient said inlet opening upwardly at said predetermined oblique angle from said circuit board.

17. The circuit board connector as set forth in claim 16, wherein said first and second mounting leg circuit board-contacting portions are aligned in a common horizontal plane.

18. The circuit board connector as set forth in claim 16, wherein said first and second mounting leg circuit board-contacting portions abuttingly contact an upper surface of said circuit board when said connector is mounted on said circuit board.

19. The circuit board connector as set forth in claim 16, wherein said exterior shell and said first and second mounting legs are formed from a conductive metal, such that said exterior shell provides an exterior grounding shield for said connector.

20. The circuit board connector as set forth in claim 19, wherein said exterior shell includes opposing top and bottom walls and two opposing sidewalls and a rear wall, all of the top, bottom and rear walls and the opposing sidewalls and said first and second mounting legs being formed from a single metal sheet.

* * * * *